United States Patent [19]

Yashiki

[11] Patent Number: 4,518,669

[45] Date of Patent: May 21, 1985

[54] ELECTROPHOTOGRAPHIC PHOTOSENSITIVE MEMBER

[75] Inventor: Yuichi Yashiki, Yokohama, Japan

[73] Assignee: Canon Kabushiki Kaisha, Tokyo, Japan

[21] Appl. No.: 547,243

[22] Filed: Oct. 31, 1983

[30] Foreign Application Priority Data

| | | | |
|---|---|---|---|
| Nov. 6, 1982 | [JP] | Japan | 57-195062 |
| Nov. 12, 1982 | [JP] | Japan | 57-198357 |
| Nov. 19, 1982 | [JP] | Japan | 57-203955 |

[51] Int. Cl.[3] ..... G03G 5/14

[52] U.S. Cl. ..... 430/57; 430/60; 430/63; 430/65

[58] Field of Search ..... 430/60, 64, 65, 62

[56] References Cited

U.S. PATENT DOCUMENTS

| | | | |
|---|---|---|---|
| 2,979,402 | 4/1961 | Greig | 430/63 X |
| 3,393,070 | 7/1968 | Snelling | 430/63 X |
| 3,684,503 | 8/1972 | Humphriss et al. | 430/63 X |
| 3,837,850 | 9/1974 | Miyatuka | 430/84 |

FOREIGN PATENT DOCUMENTS

| | | |
|---|---|---|
| 1797368 | 8/1971 | Fed. Rep. of Germany . |
| 2433853 | 3/1975 | Fed. Rep. of Germany . |
| 3114626 | 4/1982 | Fed. Rep. of Germany . |

*Primary Examiner*—John D. Welsh

*Attorney, Agent, or Firm*—Fitzpatrick, Cella, Harper & Scinto

[57] ABSTRACT

An electrophotographic photosensitive member provided with a novel intermediate layer between the substrate and the photosensitive layer. This intermediate layer is a resin layer in which an alumina- or tin oxide-treated titanium oxide powder is dispersed. The thickness of this intermediate layer is the second power or more of the maximum surface roughness of the substrate when the length is denoted in terms of a micron as a unit.

57 Claims, No Drawings

ELECTROPHOTOGRAPHIC PHOTOSENSITIVE MEMBER

BACKGROUND OF THE INVENTION

1. Field of the Invention

This invention relates to an electrophotographic photosensitive member provided with an intermediate layer between the substrate and the photosensitive layer, and particularly to a novel intermediate layer with which performance characteristics of the electrophotographic photosensitive member have been improved.

2. Description of the Prior Art

Electrophotographic photosensitive members have on a substrate a photosensitive layer containing a photoconductive material such as Se, Se-Te, Se-Te-As, ZnO, CdS, CdSe, amorphous Si, PVK, phthalocyanine, pyrazoline, or the like.

Organic photoconductive materials have many advantages over inorganic ones, such as the lightness in weight, high productivity, and so forth, but were difficult to put into practical use, on account of the low sensitivity. In consequence, some sensitizing techniques have been suggested, among which an effective one is to use a laminate type photosensitive member having two laminated photosensitive layers which function separately as a charge generation layer and a charge transport layer.

In this type of photosensitive member, the charge generation layer is very thin and hence is liable to be affected by the surface state of the substrate when formed thereupon, that is, the roughness of the substrate surface causes coating irregularities or thickness irregularities of the charge generation layer. Occurrence of these irregularities must be prevented as far as possible because they will cause defects or uneven density in the resulting images. Therefore the substrate surface is finished in the conventional process to reduce the maximum surface roughness to 1$\mu$ or less by additional processing such as grinding or polishing. Such processing results in the raise of the cost of electrophotographic photosensitive members.

Thus, an intermediate layer has become set up between the substrate and the photosensitive layer aiming at eliminating these irregularities and achieving other effects such as improvements of the adhesion and coating workability of the photosensitive layer material, protection of the substrate, covering of surface defects of the substrate, protection of the photosensitive layer from electric destruction, and improvement of the injectability of electric charge from the substrate into the photosensitive layer.

It is known that the intermediate layer can be formed from, e.g. poly(vinyl alcohol), poly(vinyl methyl ether), poly(N-vinylimidazole), ethyl cellulose, methyl cellulose, ethylene-acrylic acid copolymer, casein, gelatin, or polyamide.

Characteristics required to the intermediate layer are, in the first place, electric properties. Since this layer is used in an electrophotographic photosensitive member, it is important for the layer to exert no adverse effect on the electrophotographic characteristics of the photosensitive member and hence to have a low electric resistance. If the electric resistance is too high, some of the charged potential is also applied to the intermediate layer and remains as so-called residual potential, which will cause the fogging of formed image.

In addition, the electric resistance of the intermediate layer is required not to be affected by any change in the ambient conditions, particularly by the variation of the atmospheric humidity. For instance, if the electric resistance increases with decreasing humidity, the fogging will be caused by low humidity.

While such characteristics as noted above are required by the intermediate layer, these requirements were scarcely satisfied in the past with a single-resin layer. Thus, according to the prior art, a very thin resin layer or a resin layer in which a conductive powder (powder of nickel, copper, silver, or some other metals) is dispersed is used as an intermediate layer. However, decreasing the thickness of the resin layer is defective since this sacrifies functions of the intermediate layer, and the metallic powder dispersion layer is also defective in that the surface property of the intermediate layer is impaired by coarse metallic particles.

SUMMARY OF THE INVENTION

An object of this invention is to provide a novel electrophotographic photosensitive member which surmounts the above noted difficulties relating to the production of electrophotographic photosensitive members.

Another object of this invention is to provide an electrophotographic photosensitive member which permits omitting or simplifying the surface processing of the substrate.

Another object of this invention is to provide an electrophotographic photosensitive member which has an intermediate layer permitting substantial elimination of defects on the coarse faced substrate.

Another object of this invention is to provide an electrophotographic photosensitive member which has an intermediate layer between the substrate and the photosensitive layer, said intermediate layer having a smooth surface on the photosensitive layer side and being made of a material of enough low resistivity formable as a thick layer.

Another object of this invention is to provide an electrophotographic photosensitive member which can reproduce images of good quality.

According to one aspect of the present invention, there is provided an electrophotographic photosensitive member having an intermediate layer between the substrate and the photosensitive layer, characterized in that the intermediate layer comprises a surface-treated titanium oxide powder and a binder.

According to another aspect of the present invention, there is provided an electrophotographic photosensitive member for laser beam printers which has as intermediate layer between the substrate and the photosensitive layer, characterized in that the intermediate layer comprises a surface-treated titanium oxide powder and a binder.

According to a further aspect of the present invention, there is provided an electrophotographic photosensitive member for laser beam printers, wherein the photosensitive layer is a lamination of a charge generation layer and a charge transport layer.

According to a further aspect of the present invention, there is provided an electrophotographic photosensitive member having an intermediate layer between the substrate and the photosensitive layer, characterized in that the intermediate layer is a resin layer in which a titanium oxide powder and a tin oxide powder are dispersed.

According to a further aspect of the present invention, there is provided an electrophotographic photosensitive member having an intermediate layer between the substrate and the photosensitive layer, characterized in that the intermediate layer is a resin layer in which a surface-treated titanium oxide powder and a surface-untreated titanium oxide powder are dispersed.

According to further aspect of the present invention, there is provided an electrophotographic photosensitive member having an intermediate layer between the substrate and the photosensitive layer, characterized in that the intermediate layer has a thickness of the second power or more of the maximum surface roughness of the substrate when the length is denoted in terms of a micron as a unit.

DESCRIPTION OF THE PREFERRED EMBODIMENTS

In a preferred embodiment of the electrophotographic photosensitive member of this invention, a resin layer in which a titanium oxide ($TiO_2$) powder surface-treated with tin oxide or with alumina is dispersed may be used as the intermediate layer between the substrate and the photosensitive layer.

In this intermediate layer, there may be incorporated tin oxide powder for improving the electric conductivity and surface-untreated titanium oxide powder for improving the surface smoothness. Either of the crystal types, rutile and anatase, of titanium oxide may be used as the titanium oxide, but rutile type is preferable.

The titanium oxide powder treated and coated with tin oxide or that treated and coated with alumina is superior to tin oxide powders in the dispersibility in the resin.

The surface treatment of titanium oxide powder with tin oxide can be carried out, for example, by dispersing a titanium oxide powder in hot water, and adding an acetone solution of $SnCl_2$ thereby hydrolize $SuCl_2$ and deposit $SnO_2$ on the surface of the titanium oxide powder.

The titanium oxide powder surface-treated with alumina has improved dispersibility and surface smoothness. The treatment of titanium oxide powder with alumina can be carried out, for example, by dispersing a titanium oxide powder in an aqueous solution of aluminum salt, adding alkali thereto to deposit aluminum hydroxide on the titanium oxide powder, and igniting the resulting titanium oxide powder.

The cost of surface finishing is markedly high when the substrate surface is finely finished to a maximum roughness of less than $1\mu$. According to this invention, sufficiently high quality images can be obtained even when the maximum roughness of the substrate surface is greater than $1\mu$. However, when the substrate surface is too coarse, formation of defective image cannot be avoided even with the resin layer set up according to this invention. The upper limit of the surface roughness is about $100\mu$.

For the intermediate layer, any resin may be used that meets the following requirements: (1) it strongly adheres to the substrate, (2) the above powder is well dispersed therein, and (3) it has sufficient solvent resistance. Resins particularly suitable herein are thermosetting resins including, for example, curable rubbers, polyurethane resins, epoxy resins, alkyd resins, polyester resins, silicone resins, and acrylic-melamine resins. The resin in which the surface-treated titanium oxide is dispersed may have a volume resistivity of up to $10^{13}$ $\Omega$cm, preferably up to $10^{12}$ $\Omega$cm. For meeting this, the intermediate layer preferably contains 5–50% by weight of tin oxide and 5–60% by weight of titanium oxide, the remainder being the resin. This content of tin oxide is that of the tin oxide present in the form of powder and/or in the form of coat on the titanium oxide treated therewith in the intermediate layer.

These powders can be dispersed in the resin by usual means including, for example, roll mills, ball mills, vibrating ball mills, attritors, sand mills, and colloid mills. For applying the dispersion, wire bar coating, blade coating, knife coating, roll coating, screen coating and the like are suitable when the substrate is in sheet form and dip coating when it is cylindrical.

The thickness of the coat is chosen according to the surface roughness of the substrate so as to secure the smoothness of the coating face. Desirably, the thickness is at least two times the maximum surface roughness of the substrate when the length is denoted in terms of micron as a unit.

When a coating material for forming the charge generation layer is applied directly on the coat in which the surface-treated titanium oxide is dispersed, pigment particles of the charge generation layer will be buried in fine pores present on the titanium oxide-containing coat or a change will occur in photosensitivity characteristics of the charge generation layer. Accordingly, the coat containing the surface-treated titanium oxide dispersed is required to be covered with a resin layer not containing conductive powder. Examples of the resin for this layer are water-soluble ones such as poly(vinyl alcohol), poly(vinyl methyl ether), poly-(vinyl ethyl ether), polyvinylpyridine, polyvinylpyrrolidone, poly-(ethylene oxide), poly(acrylic acid) resins, methyl cellulose, ethyl cellulose, poly(glutamic acid), casein gelatin, and starch and water-insoluble resins such as polyamides, phenolic resins, poly(vinyl formal), polyurethane elastomers, alkyd resins, ethylenevinyl acetate copolymers, and vinyl pyrrolidone-vinyl acetate copolymer. According to the experiments of the present inventors, polyamide resins are best suited. These polyamide resins are linear ones, typical examples of which are nylons and nylon copolymers. In this invention, low crystalline or amorphous nylons are preferred since resins for this layer are suitably applied in the form of solution. Such nylons can be obtained by copolymerization. The raw materials of these nylons include, for example; caprolactam or 6-aminocaproic acid (for nylon 6), hexamethylene-diamine and dicarboxylic acids such as adipic acid and sebasic acid (for nylon 66 and nylon 610), 11-aminoundecanoic acid (for nylon 11), and $\omega$-laurolactam or 12-aminododecanoic acid (for nylon 12).

Suitable thickness of the polyamide resin layer is approximately $0.3–2\mu$. The charge generation layer and charge transport layer, which will be described later, are formed on this resin layer free of conductive powder to form an electrophotographic photosensitive member.

The electrophotographic photosensitive member of this invention can be produced at a low cost for processing the substrate, since the substrate is allowed to have a rough surface. The intermediate layer consisting of a dispersion of the above described powder has a nature to scatter a light beam at its surface and hence, for instance, can prevent the reflection of a laser beam from the substrate surface and hence the interference of the reflected laser beam. Accordingly, the electrophotographic photosensitive member of this invention can also be used effectively for the so-called laser beam printer and the like which employ a laser as the light source.

In embodiment of this invention, a resin layer in which a tin oxide ($SnO_2$) powder and a titanium oxide ($TiO_2$) powder are dispersed may be formed as the intermediate layer between the substrate and the photosensitive layer. This embodiment gives an intermediate layer having a satisfactory surface.

Since the tin oxide powder has a sufficiently low resistivity, the intermediate layer can be made up by dispersing the tin oxide powder alone in a resin. However, the tin oxide powder is inferior in dispersibility and hence will raise a problem in the surface smoothness if dispersed singly. The resistivity of tin oxide powder in the coating film is in the order of $10^5$–$10^8$ Ωcm, which is sufficiently low for use in the intermediate layer. Suitable contents of tin oxide are 0.1–10 parts, particularly 0.5–5 parts, by weight per 1 part by weight of the resin contained in the intermediate layer.

The titanium oxide powder is a white pigment called titanium white, the resistivity of which in the coating film is in the order of $10^{11}$–$10^{15}$ Ωcm, which is lower than those of usual insulation materials. Hence, the titanium oxide powder can be used in relatively large amounts when dispersed along with the tin oxide powder. Suitable contents of titanium oxide are also 0.1–10 parts, particularly 0.5–5 parts, by weight per 1 part by weight of the resin contained in the intermediate layer. The titanium oxide powder has a great surface-smoothing effect because its particle size is as fine as 1μ or less and it has a high hiding power. Accordingly, it is possible by incorporating a combination of titanium oxide and tin oxide to form an intermediate layer having a resistivity of $10^{12}$ Ωcm or less, which is enough low to meet the values required for the intermediate layer, and having a smooth surface. The mixing ratio in weight of titanium oxide to tin oxide is desirably in the order of 10:1–1:1. The titanium oxide in this case may be of either rutile type or anatase type or further mixtures thereof, but the rutile type is particularly preferred.

The resin used for the intermediate layer in this embodiment may be either thermoplastic resin or thermosetting resin, the former including polyester resins, acrylic resins, vinyl acetate resins vinyl chloride-vinyl acetate copolymer resins, and the like and the latter including alkyd resins, melamine resins, urethane resins, epoxy resins, silicone resins, phenolic resins, and the like, but the resin is chosen taking into consideration the adhesion to the substrate, the pigment-dispersing property, etc. In view of the solvent resistance, thermosetting resins are preferred.

Various kinds of organic solvent can be incorporated into the coating material used to form the intermediate layer. The solvent is chosen depending upon the nature of the resin, but generally used solvents are alcohols such as methanol, ethanol and isopropanol; ketones such as acetone, methyl ethyl ketone and cyclohexanone; amides such as N,N-dimethylformamide and N,N-dimethylacetamide; sulfoxides such as dimethylsulfoxide; ethers such as tetrahydrofuran, dioxane and ethylene glycol monomethyl ether; esters such as methyl acetate and ethyl acetate; halogenated aliphatic hydrocarbons such as chloroform, methylene chloride, dichloroethylene, carbon tetrachloride, and trichloroethylene; and aromatic hydrocarbons or chlorinated derivatives thereof such as benzene, toluene, xylene, ligroin, monochlorobenzene and dichlorobenzene.

Coating methods applicable in this case are dip coating, spray coating, spinner coating, bead coating, Meyer bar coating, blade coating, roller coating, curtain coating, etc.

Also in this embodiment, a resin layer free of conductive powder may be set up between the intermediate layer containing tin oxide and titanium oxide powders. Particularly, when the photosensitive layer is of the separated function type consisting of a charge generation layer and a charge transport layer, this resin layer free of conductive powder is very effective for improvement of the coating workability of the photosensitive layer material, prevention of solvent penetration, improvement of the drying characteristic, and improvements of electrophotographic characteristics, since the charge generation layer is generally very thin. For this resin layer, the above-cited resins for the intermediate layer can also be used. This resin layer may be considerably thin because the underlying layer containing titanium oxide and tin oxide plays its role and this resin layer protect it.

Suitable thickness of the intermediate layer in this embodiment is in the order of 1–20μ, particularly 2–15μ. The overlying resin layer is formed to a thickness of 0.1–5μ, particularly 0.2–1μ. When these layers are too thin the desired effect cannot be obtained, and when too thick, the electric resistance will be high and hence the layers are liable to accumulate residual charge.

In another preferred embodiment of this invention, the thickness of the intermediate layer to be formed between the substrate and the photosensitive layer is made the second power or more of the maximum surface roughness of the substrate when the length is denoted in terms of μ and said roughness is as large from 1 micron to 5 microns. That is, even if the substrate surface, insufficiently polished, has a maximum roughness of 1μ or more, the electrophotographic photosensitive member provided with such a sufficiently thick intermediate layer between the substrate and the photosensitive layer gives good quality copies free from white spots and black spots. On the contrary, a photosensitive member having no such intermediate layer gives copies often stained with white or black spots caused by projections or depressions of 1μ or more on the substrate surface, thus no good quality image being obtainable with such a photosensitive member.

It has been found out that only one irregularity 1μ or more coarse present on the substrate surface can cause a defect such as a white or black spot on the resulting copy even though the substrate has a lower average surface roughness. Further, from studies on the relation between the maximum surface roughness and the minimum thickness of the intermediate layer that can prevent the development of such a defect by covering the roughness, it has been found that the occurrence of the defect can be prevented with the intermediate layer as thick as the second power or more of the maximum surface roughness of the substrate when denoted in a μ unit.

Since the intermediate layer is considerably thick, it is especially effective to reduce the electric resistance of the intermediate layer by incorporating a low resistivity material thereinto, for the purpose of satisfying the following requirements: (1) the intermediate layer material can be applied on the substrate without causing any coating defect such as cissing (peeling due to rejection), sagging, pinhole, or uneven thickness, (2) the intermediate layer is not attacked by the solvent in the coating material for forming the photosensitive layer, (3) the intermediate layer has such a low electric resistance as not to store the residual charge, (4) in particular, the intermediate layer does not store the residual charge in low humidity environments.

Suitable low resistivity materials for this purpose are conductive fine powders such as those of metals including aluminum, nickel, copper, silver, gold, zinc, tin, titanium, lead, and indium; those of theses metal oxides; and carbon powders. The thickness of the intermediate layer can be increased by dispersing such a conductive powder therein. The resistivity of the intermediate layer is desired to be up to $10^{13}$ Ωcm. A desired resistance of this layer can be obtained by proper selection of conductive fine powders and mixing ratios thereof. The smaller particle size of the conductive fine powder produce the better results; particle sizes of 1μ and less are particularly preferable.

The intermediate layer is best formed by using a resin. Suitable resins for this purpose include; water-soluble resins, for example, poly(vinyl alcohol), poly(vinyl methyl ether), poly(vinyl ethyl ether), polyvinylpyridine, polyvinylpyrrolidone, poly(ethylene oxide), poly(acrylic acid) resis, methyl cellulose, ethyl cellulose, poly(glutamic acid), casein, gelatin, and starch; and water-insoluble resins, for example, melamine resins, polyamides, epoxy resins, polyurethanes, and polyglutamic acid esters. In particular, when the intermediate layer is formed by dispersing the above conductive fine powder, the resin is required to meet the following requirements: (1) the resin strongly adheres to the substrate, (2) the conductive fine powder is well dispersed in the resin, and (3) the resin has sufficient solvent resistance. Preferred resins for meeting these requirements are thermosetting resins such as polyurethane resins, epoxy resins, alkyd resins, polyester resins, silicone resins, acryl-melamine resins, phenolic resins, and the like.

Some conductive fine powders have a nature of injecting free carriers into the photosensitive layer. When such a powder is dispersed in the intermediate layer, the potential decay in the photosensitive layer is increased, leading to difficult formation of image. In such a case, the injection of free carriers can be prevented by forming a second resin layer free from such a conductive fine powder, on the intermediate layer containing the conductive fine powder.

This second layer can be formed by using the resins including water-soluble resins, for example, poly(vinyl alcohol), poly(vinyl methyl ether), poly(vinyl ethyl ether), polyvinylpyridine, polyvinylpyrrolidone, poly(ethylene oxide), poly(acrylic acid) resins, methyl cellulose, ethyl cellulose, poly(glutamic acid), casein, gelatin, and starch; and water-insoluble resins, for example, melamine resin, polyamide, epoxy resin, polyurethane, and polyglutamic acid esters.

The coating material used for forming the intermediate layer can be prepared by dissolving the above resin in a suitable organic solvent. Examples of the organic solvent are; alcohols such as methanol, ethanol, and isopropanol; ketones such as acetone, methyl ethyl ketone, and cyclohexanone; amides such as N,N-dimethylformamide and N,N-dimethylacetamide; sulfoxides such as dimethylsulfoxide; ethers such as tetrahydrofuran, dioxane, and ethylene glycol monomethyl ether; esters such as methyl acetate and ethyl acetate; halogenated aliphatic hydrocarbons such as chloroform, methylene chloride, dichloroethylene, carbon tetrachloride, and trichloroethylene; and aromatic solvents such as benzene, toluene, xylene, ligroin, monochlorobenzene, and dichlorobenzene.

The coating can be carried out by dip coating, spray coating, spinner coating, bead coating, Meyer bar coating, blade coating, roller coating, curtain coating, or the like.

The electrophotographic photosensitive member of this invention is further described below.

Suitable substrates in this invention include; flat or cylindrical form of metals, e.g. aluminum, brass, silver, copper, chromium, nickel, and stainless steel; and insulators such as plastic films and hard paper which are laminated, vacuum metalized, or plated with such a metal as mentioned above. Suitable plastic films for use in this case are those of poly(ethylene terephthalate), polyethylene, polypropylene, phenolic resins, acrylic resins, etc. The substrate is allowed to have a maximum surface roughness of 1μ or more.

The photosensitive layer formed on this substrate with the above-described intermediate layer interposed may be any of those well known in the art, including, for example; a coating layer formed from a dispersion of an inorganic photoconductive material such as zinc oxide, cadmium sulfide, or the like, in a binder; a layer formed by vapor deposition of selenium, selenium-tellurium, perylene pigment or the like; a separated function type laminate consisting of a charge generation layer and a charge transport layer; and a coating layer comprising an organic photoconductive polymer such as polyvinylcarbozole polyvinylpyrene, polyvinylanthracene, or the like.

The charge generation layer is formed by applying a dispersion of a charge-generating material in a binder solution on the treated substrate. Example of the charge-generating material are azo pigments such as Sudan Red, Dian Blue, and Janus Green B; quinone pigments such as Algol Yellow; Pyrene Quinone, and Indanthrene Brilliant Violet RRP; Quinocyanine pigments; perylene pigments; indio pigments such as indigo and thioindigo; bisbenzoimidazole pigments such as Indian Fast Orange Toner; phthalocyanine pigments such as copper phthalocyanine; and quinacridone pigments. Examples of the binder are polyesters, polystyrenes, poly(vinyl chloride), poly(vinyl acetate), acrylic resins, polyvinylpyrrolidone, methyl cellulose, hydroxypropylmethyl cellulose, and poly(vinyl butyral). The thickness of the charge generation layer is 0.01–1μ, preferabely 0.05–0.5μ.

The charge transport layer laid on the charge generation layer is formed from a solution of a charge-transporting material in a film-forming resin solution. Examples of the charge-transporting material are: polycyclic aromatic compounds such as anthracene, pyrene, phenanthrene, and coronene; derivatives of nitrogen-containing cyclic compounds such as indole, carbazole, oxazole, isoxazole, thiazole, imidazole, pyrazole, oxadiazole, pyrazoline, thiadiazole, and triazole; and hydrazone compounds. The reason for using a resin having the film-forming property is that charge-transporting materials are generally deficient in the film-forming property in themselves. Examples of the resin are polyesters, polysulfones, polycarbonates, poly(methacrylic esters), polystyrenes, and styreneacrylonitrile copolymers. The thickness of the charge transport layer is 5 to 20μ.

The intermediate layer in the electrophotographic photosensitive member of this invention can sufficiently cover even a substrate having defects on the surface since this layer has a smooth surface, great hiding power, and low resistivity which permits increasing the layer thickness.

In addition, the cost of finishing of the substrate surface can be reduced according to this invention since the rough surface is covered by the intermediate layer which is formed with the thickness ($\mu$) of the second power or more of the maximum surface roughness ($\mu$) of the substrate.

This invention is further illustrated with reference to the following Examples. In the Examples, "parts" and "%" are all by weight.

EXAMPLE 1

In this Example, aluminum cylinders (60 mm$\phi\times$260 mm) were used as substrates, which were found to have a maximum surface roughness of 11$\mu$.

In this Example and also the following Examples, the maximum surface roughness was measured with a surface roughness meter. Talysurt (tradename), supplied by Rank Taylor Hobson Co. (England).

40 parts of a tin oxide-treated rutile type titanium oxide powder (content of deposited tin oxide: 43%) and 60 parts of a rutile type titanium oxide powder were mixed with a solution of 80 parts of an acrylic resin (tradename: Acrydik A405, supplied by Dainippon Ink and Chemicals, Inc., solid content 50%) and 20 parts of a melamine resin (tradename: Superbeckamin L-121, supplied by the above company, solid content 60%) in 100 parts of toluene. The mixture was ground in a ball mill for 6 hours. The resulting dispersion was coated on one of the aluminum cylinder by dipping and heat-cured at 150° C. for 30 minutes, forming an intermediate layer 25$\mu$ thick. The maximum surface roughness measured of this layer was 0.9$\mu$, indicating that the surface of this layer is far more smooth than that of the substrate.

Then, a solution of 10 parts of a nylon copolymer resin (tradename: Amylan CM 8000, manufactured by Toray Industries Inc.) in a mixture of 60 parts of methanol and 40 parts of butanol was coated on the intermediate layer by dipping to form a polyamide resin layer 1$\mu$ thick.

10 parts of a disazo pigment represented by the formula:

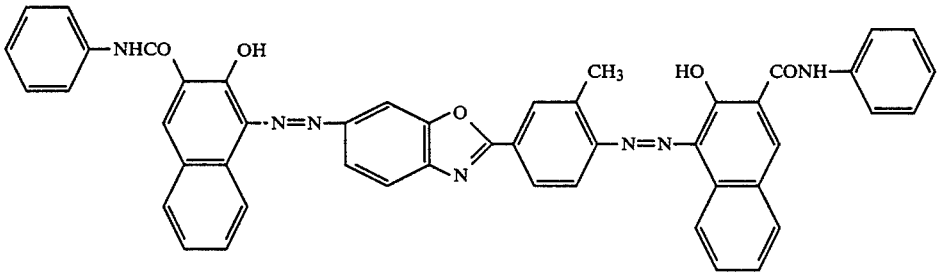

and 6 parts of a cellulose acetate-butyrate resin (tradename: CAB-381 manufactured by Eastman Chem. Products Inc.) were ground in 60 parts of cyclohexanone for 20 hours by means of a sand mill using 1 mm$\phi$ glass beads. The resulting dispersion, mixed with 100 parts of methyl ethyl ketone, was coated on the above polyamide resin layer by dipping, and dried at 100° C. for 10 minutes, forming a charge generation layer of 0.1 g/m$^2$ of coating.

A solution of 10 parts of the hydrazone represented by the formula:

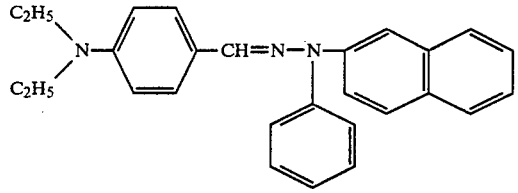

and 15 parts of a styrene-methyl methacrylate copolymer resin (tradename: MS 200 manufactured by Seitetsu Chem. Co., Ltd.) in 80 parts of toluene was coated on the above charge generation layer and dried in hot air at 100° C. for 1 hour, forming a charge transport layer 16$\mu$ thick.

Then, performance characteristics of the thus prepared electrophotographic photosensitive member were evaluated by using an electrophotographic copying machine which had the stages of −5.6 IV corona charging, image exposure, dry-toner development, toner transfer to plain paper, and cleaning with an urethane rubber blade (hardness 70°, contact pressure 10 gw/cm, angle to the photosensitive member 20 degree). This photosensitive member indicated a charged potential of −620 V and gave good quality images.

For the comparison, another photosensitive member was prepared in the same manner using the same materials as in the above experiment, except that the resin layer containing oxide powder particles was not coated and the polyamide resin layer was formed directly on the substrate aluminum cylinder. This photosensitive member gave defective copies stained with a pattern correspondent to the surface roughness of the substrate.

A still further photosensitive member was prepared in the same manner using the same materials as in the first experiment, except that the intermediate layer was formed with the acryl-melamine resin alone without incorporating the powder. This photosensitive member indicated a charged potential of about −800 V and gave defective copies with marked fogging. This fogging was due to residual potential.

EXAMPLE 2

In this Example, the same aluminum cylinder as used in Example 1 (60 mm$\phi\times$260 mm, the maximum surface roughness 11$\mu$) was used as the substrate.

40 parts of a tin oxide powder and 60 parts of an alumina-treated rutile type titanium oxide powder (content of deposited alumina: 12%) were mixed with a solution of 60 parts of an acrylic resin (Acrydik A 405) and 20 parts of a melamine resin (Superbeckamin L 121) in 100 parts of toluene. The mixture was ground in a ball mill for 6 hours. The resulting dispersion was coated on the substrate by dipping and heat-cured at 150° C. for 30 minutes, forming an intermediate layer 25μ thick. The maximum surface roughness of this layer was 0.9μ.

Thereafter, the intermediate layer was overlaid successively with the same polyamide resin layer, charge generation layer, and charge transport layer as formed in Examples 1. The thus prepared photosensitive member gave good quality images.

EXAMPLE 3

The same aluminum cylinder as used in Example 1 (60 mmϕ×260 mm, the maximum surface roughness 11μ) was employed.

40 parts of a tin oxide-treated titanium oxide powder (the same as used in Example 1) and 60 parts of an alumina-treated titanium oxide (the same as used in Example 2) were mixed with a solution of 80 parts of an acrylic resin (Acrydik A 405) and 20 parts of a melamine resin (Superbeckamin L 121) in 100 parts of toluene. The mixture was ground in a ball mill for 6 hours. The resulting dispersion was coated on the substrate by dipping and heat-cured at 150° C. for 30 minutes, forming an intermediate layer 25μ thick. The maximum surface roughness measured of this layer was 0.8μ.

Thereafter, the intermediate layer was overlaid successively with the same polyamide resin layer, charge generation layer, and charge transport layer as formed in Example 1. The thus prepared photosensitive member gave good images.

EXAMPLE 4

Aluminum cylinders having a maximum surface roughness of 15μ were employed as substrates.

The same dispersion as used in Example 3, containing the tin oxide-treated titanium oxide powder and the alumina-treated titanium oxide powder, was coated on the substrates to two thickness values of 25μ and 30μ. After being cured, each coating was overlaid successively with the same polyamide resin layer and photosensitive layers as formed in Example 1. Image-forming tests of the thus prepared photosensitive members showed that, while the one having the 25μ thick intermediate layer gave copies where streaks were observed but to a very limited extent, the other one having the 30μ thick intermediate layer gave clean good copies.

EXAMPLE 5

T parts (shown below) of a titanium oxide powder (mfd. by Sakai Chem. Co., Ltd.), S parts (shown below) of a tin oxide powder (Mitsubishi Metal Co., Ltd.), 16 parts of a single liquid type epoxy resin (tradename: U 33, mfd. by Amicon Japan, Solid content 50%), and 30 parts of toluene were ground in a ball mill for 6 hours. The above parts T and S are shown in Table 1.

TABLE 1

| Sample | T | S |
|---|---|---|
| A | 10 | 4 |
| B | 16 | 0 |
| C | 0 | 8 |

Each of the resulting dispersions was applied on a 50μ thick aluminum sheet by means of a wire bar coater and heat-cured at 150° C. for 30 minutes, forming an intermediate layer 10μ thick. Volume resistivities of this sheet were measured in the ordinary humidity environment (25° C., 60%RH) and a low humidity environment (15° C., 10%RH). The surface roughness was also measured on these samples. Results are shown in Table 2.

TABLE 2

| Sample | Resistivity (ordinary humidity) | Resistivity (low humidity) | Surface roughness |
|---|---|---|---|
| A | $4 \times 10^{10}$ Ωcm | $6 \times 10^{10}$ Ωcm | 1μ |
| B | $5 \times 10^{12}$ | $8 \times 10^{14}$ | 0.5 |
| C | $1 \times 10^{9}$ | $2 \times 10^{9}$ | 4 |

As shown above, Sample B of titanium oxide alone, though having a small surface roughness, indicated much increased resistivity in a low humidity environment; on the contrary, Sample C of tin oxide alone, though indicating low resistivity, had a large maximum surface roughness.

Then, each of the above dispersions was coated by dipping on the surface of an aluminum cylinder (80ϕ×300 mm) and heat-cured forming an intermediate layer 10μ thick.

Then, 50 parts of an zinc oxide powder for electrophotography (mfd. by Hakusui Chem. Co., Ltd.) was dispersed in a solution consisting of 0.2 part of Rose Bengal (tradename: N 164, mfd. by Dainippon Ink and Chemicals Inc.), 5 parts of methanol, and 50 parts of n-heptane by mixing in a homogenizer for 20 minutes. The dispersion was filtered with suction to take out the solid, which was then well dried at 80° C. Thus, a pigment-sensitized zinc oxide powder was obtained.

Then, 30 parts of this zinc oxide was ground together with 12 parts of an acrylic resin (tradename: Acrybase CMZ-20, mfd. by Fujikura Kasei Co., Ltd., solid content 40%) and 45 parts of toluene in a ball mill for 4 hours. The resulting dispersion was coated on each intermediate layer and well dried at 80° C., forming a photosensitive layer 2.2μ thick.

Then, an emulsion of acrylic resin (weight-average mol. wt. ca. 120,000, glass transition temperature ca. 90° C., tradename: Aron HD-11, mfd. by Toa Gosei Chem. Co., Ltd.), diluted with water to a viscosity of 15 cps, was coated on each photosensitive layer and dried in a 70° C. hot air stream, thus forming a protective coat 4μ thick.

The prepared photosensitive drums were subjected to an image-forming test using an electrophotographic copying machine, the test including the processes of −5.5 KV charging, image exposure, dry-toner development, toner transfer to plain paper, and cleaning with an urethane rubber blade (thickness 1 mm, hardness 70°, contact pressure 4 g/cm, angle to the photosensitive member 30 degree).

The results showed that; the photosensitive drum prepared by using Sample A gave good quality images in either the ordinary humidity environment (25° C., 60%RH) or the low humidity environment (15° C., 10%RH); the photosensitive drum prepared by using Sample B gave often foggy copies in the low humidity environment; and the photosensitive drum prepared by using Sample C gave copies throughout the face of which fine spots were observed.

A photosensitive drum was prepared in the same manner as the above but by forming the photosensitive layer directly on the aluminum cylinder without covering it any intermediate layer. Full-face black images were formed by using this photosensitive drum, but numerous white spots appeared on these images.

As shown above, the photosensitive drum having an intermediate layer according to this invention gave best images.

EXAMPLE 6

10 parts of a titanium oxide powder (mfd. by Titan Kogyo Co., Ltd.), 7 parts of a tin oxide powder (mfd. by Mitsubishi Metal Co., Ltd.), 16 parts of an acrylic resin (Acrydic A 405), and 4 parts of a melamine resin (Superbeckamin L 121) were ground for 6 hours in the presence of 20 parts of toluene by using a ball mill. The resulting dispersion was coated on the surface of an aluminum cylinder (80 mmϕ×300 mm) and heat-cured at 150° C. for 30 minutes, forming an intermediate layer 10μ thick.

A 4% methanolic solution of a polyamide resin (Amylan CM-8000) was coated on the intermediate layer to form a resin layer 0.6μ thick.

Similarly to Example 1, 10 parts of a disazo pigment represented by the formula:

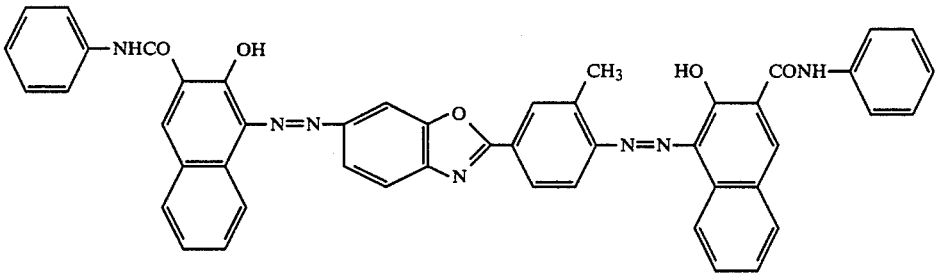

and 6 parts of a cellulose acetate-butyrate resin (CAB-381) were ground in 60 parts of cyclohexanone for 20 hours by means of a sand mill using 1 mmϕ glass beads. The resulting dispersion, mixed with 100 parts of methyl ethyl ketone, was coated on the polyamide resin layer by dipping and dried at 100° C. for 10 minutes, forming a charging generation layer of 0.1 g/m$^2$ of coating weight.

A solution of 10 parts of the hydrazone represented by the formula

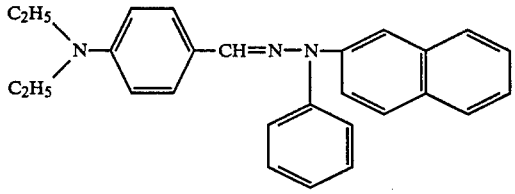

and 12 parts of a styrene-methyl methacrylate copolymer resin (MS 200) in 70 parts of toluene was coated on the charge generation layer and dried at 100° C. for 60 minutes, forming a charge transport layer 16μ thick.

The thus prepared photosensitive member was set in the copying machine used in Example 5, and on operation, good quality images were obtained.

EXAMPLE 7

An aluminum pipe (60 mm in outer dia. and 55 mm in inner dia.) was cut into 300-mm long cylinders to use as substrates. The maximum surface roughness measured was 4μ.

25 parts of carbon black (average particle size 0.05μ), 120 parts of an acrylic resin (Acrydik A 405), and 25 parts of a melamine resin (Superbeckamin L 121) were ground in the presence of 80 parts of toluene by means of a roll mill. The resulting dispersion was coated on one of the aluminum cylinders by dipping and heat-cured at 150° C. for 30 minutes, forming an intermediate layer 20μ thick.

A 4% aqueous solution of a poly(vinyl alcohol) (tradename: Poval K17E, mfd. by Denki-Kagaku Kogyo Co., Ltd.) was coated on the intermediate layer and dried at 80° C., forming a second resin layer free of conductive powder.

This layer was then overlaid successively with the same charge generation layer and charge transport layer as formed in Example 1 except that the charge transfer layer was 15μ thick and the rubber blade pressure in the cleaning process was 5 gw/cm.

The thus prepared photosensitive member indicated a charged potential of −700 V and gave good quality images.

For comparison, another photosensitive member was prepared by repeating the above procedure but without forming any second resin layer. This photosensitive member indicated a charged potential of about −200 V, hence giving no image. This was due to the hole-injecting effect of carbon powder out of the free carriers.

Another photosensitive member prepared by repeating the above procedure except that the thickness of the carbon black dispersion layer (the intermediate layer) was reduced to 10μ, which was less than the second powder of the maximum surface roughness of the substrate, gave inferior quality images where remarkable streaks and black spots were observed.

EXAMPLE 8

The same substrates as in Example 7 were used. 10 parts of tin oxide powder of particles sizes 1μ and less and 17 parts of an acrylic resin (tradename: Acrydik A 851, mfd. by Dainippon Ink and Chemicals Inc., solid content 70%) were ground in 50 parts of toluene by means of a roll mill. To the resulting dispersion was added 4 parts of a polyisocyanate (tradename: Vernock D 750, mfd. by Dainippon Ink and Chemicals Inc., solid content 75%), to prepare an urethane coating material. This coating material was sprayed on one of the substrates and heat-cured at 100° C. for 1 hour, forming an intermediate layer 18μ thick.

A solution of 10 parts of casein in 100 parts of 2% aqueous ammonia was coated on the intermediate layer by dipping and dried, forming a layer 2μ thick.

Similarly to Example 5, 50 parts of an electrophotographic purpose zinc oxide powder, 0.1 part of Rose Bengal, 0.2 part of a polyamide resin (CM 8000), 2 parts of methanol, and 60 parts of n-heptane were mixed in a homogenizer for 20 minutes. The resulting dispersion was filtered with suction, and the filter cake was dried at 80° C., giving a pigment-sensitized zinc oxide powder.

30 parts of this zinc oxide powder and 10 parts of an acrylic resin (Acrylbase OMZ-20) were ground in the presence of 40 parts of toluene in a ball mill for 4 hours. The resulting dispersion was coated on the casein layer by dipping to form a photosensitive layer 22μ thick. Then, an emulsion of acrylic resin (weight average mol. wt.:ca. 120,000, glass transition temperature:ca. 90° C., tradename: Aron HD-11, mfd. by Toa Gosei Chem. Co., Ltd.), diluted with water to a viscosity of 15 cps, was coated on each photosensitive layer and dried in a 70° C. hot air stream, thus forming a protective coat 4μ thick.

The thus prepared photosensitive member was set in a copying machine (the same as used in Example 5), and on operating it, good quality images were obtained.

In contrast to this, a photosensitive member prepared by repeating the above procedure but without forming any intermediate layer gave defective images having white spots, which were caused by partial cissing (peeling due to rejection) of the casein layer from the aluminum surface.

EXAMPLE 9

30 Parts of an epoxy resin (tradename: Epicoat 1001, mfd. by Shell Chemical Co.), 70 parts of xylene, and 10 parts of a nickel powder of average particle size 1μ were thoroughly roll-milled. The resulting dispersion, after addition of 5 parts of a triethylenetetramine hardner, was sprayed onto the same substrate as used in Example 7 and cured at 100° C. for 1 hour, forming an intermediate layer 18μ thick. This layer was then overlaid with the same photosensitive layer as formed in Example 8.

The thus prepared photosensitive member also gave good quality images. In this case, a casein layer was not particularly necessary. Further, it was found that the same photosensitive member but provided with an intermediate layer of less than 16μ in thickness gave images having streaks.

What is claimed is:

1. An electrophotographic photosensitive member having an intermediate layer between a substrate and a photosensitive layer, characterized in that the intermediate layer comprises a titanium oxide powder having a coating comprising aluminum oxide or tin oxide on the titanium oxide powder particle and a binder.

2. The electrophotographic photosensitive member of claim 1, wherein the titanium oxide is of rutile type.

3. The electrophotographic photosensitive member of claim 1, wherein the intermediate layer contains a titanium oxide powder coated with alumina and a titanium oxide powder coated with tin oxide, and a binder.

4. The electrophotographic photosensitive member of claim 1, which has a resin layer between the intermediate layer and the photosensitive layer.

5. The electrophotographic photosensitive member of claim 4, wherein the resin layer is a coat comprising at least one resin selected from the group consisting of poly(vinyl alcohol), poly(vinyl methyl ether), poly(vinyl ethyl ether), polyvinylpyridine, polyvinylpyrrolidone, poly(ethylene oxide), poly(acrylic acid), methyl cellulose, ethyl cellulose, poly(glutamic acid), casein, gelatin, starch, polyamides, phenolic resins, poly(vinyl formal), polyurethane elastomers, alkyd resins, ethylene-vinyl acetate copolymers, and vinylpyrrolidone-vinyl acetate copolymers.

6. The electrophotographic photosensitive member of claim 5, wherein the resin layer is a polyamide coat.

7. The electrophotographic photosensitive member of claim 6, wherein the polyamide is a nylon or a nylon copolymer.

8. The electrophotographic photosensitive member of claim 4, wherein the resin layer has a thickness of 0.3–2μ.

9. The electrophotographic photosensitive member of claim 1, wherein the photosensitive layer is a lamination of a charge generation layer and a charge transport layer.

10. An electrophotographic photosensitive member for laser beam printers which has an intermediate layer between the substrate and the photosensitive layer, characterized in that the intermediate layer comprises a titanium oxide powder having a coat comprising aluminum oxide or tin oxide on the titanium oxide powder particle, and a binder.

11. The electrophotographic photosensitive member for laser beam printers of claim 10, wherein the titanium oxide is of rutile type.

12. The electrophotographic photosensitive member for laser beam printers of claim 10, wherein the intermediate layer contains a titanium oxide powder coated with alumina and a titanium oxide powder coated with tin oxide, and a binder.

13. The electrophotographic photosensitive member for laser beam printers of claim 10, which has a resin layer between the intermediate layer and the photosensitive layer.

14. The electrophotographic photosensitive member for laser beam printers of claim 13, wherein the resin layer is a coat comprising at least one resin selected from the group consisting of poly(vinyl alcohol), poly(vinyl methyl ether), poly(vinyl ethyl ether), polyvinylpyridine, polyvinylpyrrolidone, poly(ethylene oxide), poly(acrylic acid), methyl cellulose, ethyl cellulose, poly(glutamic acid), casein, gelatin, starch, polyamides, phenolic resins, poly(vinyl formal), polyurethane elastomers, alkyd resins, ethylene-vinyl acetate copolymers, and vinylpyrrolidone-vinyl acetate copolymers.

15. The electrophotographic photosensitive member for laser beam printers of claim 14, wherein the resin layer is a polyamide coat.

16. The electrophotographic photosensitive member for laser beam printers of claim 10, wherein the polyamide is a nylon or a nylon copolymer.

17. The electrophotographic photosensitive member for laser beam printers of claim 13, wherein the resin layer has a thickness of 0.3–2μ.

18. The electrophotographic photosensitive member for laser beam printers of claim 10, wherein the photosensitive layer is a lamination of a charge generation layer and a charge transport layer.

19. An electrophotographic photosensitive member having an intermediate layer between the substrate and the photosensitive layer, characterized in that the intermediate layer is a resin layer in which a titanium oxide powder and a tin oxide powder are dispersed.

20. The electrophotographic photosensitive member of claim 19, wherein the titanium oxide is of rutile type.

21. The electrophotographic photosensitive member of claim 19, wherein the titanium oxide powder has been surface-treated.

22. The electrophotographic photosensitive member of claim 21, wherein the surface treatment is to form an alumina coat on the titanium oxide particle.

23. The electrophotographic photosensitive member of claim 21, wherein the surface treatment is to form a tin oxide coat on the titanium particle.

24. The electrophotographic photosensitive member of claim 19, wherein the titanium oxide is contained in an amount of 0.1–10 parts by weight per 1 part by weight of the resin in the intermediate layer.

25. The electrophotographic photosensitive member of claim 24, wherein the titanium oxide is contained in an amount of 0.5–5 parts by weight per 1 part by weight of the resin in the intermediate layer.

26. The electrophotographic photosensitive member of claim 19, wherein the weight ratio of the titanium oxide to the tin oxide, in the intermediate layer, is 1:1–10:1.

27. The electrophotographic photosensitive member of claim 19 which has a second resin layer between the intermediate layer and the photosensitive layer.

28. The electrophotographic photosensitive member of claim 19, wherein the photosensitive layer is a lamination of a charge generation layer and a charge transport layer.

29. An electrophotographic photosensitive member having an intermediate layer between a substrate and a photosensitive layer, characterized in that the intermediate layer is a resin layer in which a titanium oxide powder having a coat comprising aluminum oxide or tin oxide on the titanium oxide powder particle, and a surface-untreated titanium oxide powder are dispersed.

30. The electrophotographic photosensitive member of claim 29 wherein the titanium oxide powder with an aluminum oxide coating or a tin oxide coating on the powder particles is of rutile type.

31. The electrophotographic photosensitive member of claim 29, wherein the surface-untreated titanium oxide powder is of rutile type.

32. The electrophotographic photosensitive member of claim 29, which has a resin layer between the intermediate layer and the photosensitive layer.

33. The electrophotographic photosensitive member of claim 32, wherein the resin layer is a coat comprising at least one resin selected from the group consisting of poly(vinyl alcohol), poly(vinyl methyl ether), poly(vinyl ethyl ether), polyvinylpyridine, polyvinylpyrrolidone, poly(ethylene oxide), poly(acrylic acid), methyl cellulose, ethyl cellulose, poly(glutamic acid), casein, gelatin, starch, polyamide, phenolic resin, poly(vinyl formal), polyurethane elastomer, alkyd resin, ethylene-vinyl acetate copolymer, and vinylpyrrolidone-vinyl acetate copolymer.

34. The electrophotographic photosensitive member of claim 33, wherein the resin layer is a polyamide coat.

35. The electrophotographic photosensitive member of claim 34, wherein the polyamide is a nylon or a nylon copolymer.

36. The electrophotographic photosensitive member of claim 32, wherein the resin layer has a thickness of 0.3–2$\mu$.

37. The electrophotographic photosensitive member of claim 29, wherein the photosensitive layer is a lamination of a charge generation layer and a charge transport layer.

38. An electrophotographic photosensitive member having an intermediate layer between an electroconductive metal substrate and a photosensitive layer, characterized in that the metal substrate has a maximum surface roughness of at least 1, the intermediate layer comprises a first intermediate layer having a low electroconductive substance dispersed in a resin provided on the surface of the substrate and a second layer constituted of a resin provided on the first intermediate layer, and the first intermediate layer has a layer thickness of the second power or more of the maximum surface roughness of the metal substrate when the length is denoted in terms of a micron as a unit.

39. The electrophotographic photosensitive member of claim 38, wherein the substrate is a metal plate or a metal cylinder.

40. The electrophotographic photosensitive member of claim 39, wherein the metal plate or the metal cylinder is made of aluminum.

41. The electrophotographic photosensitive member of claim 38, wherein the first intermediate layer is a coat comprising a low resistivity material and one resin selected from the group consisting of poly(vinyl alcohol), poly(vinyl methyl ether), poly(vinyl ethyl ether), polyvinylpyridine, polyvinylpyrrolidone, poly(ethylene oxide), poly(acrylic acid), methyl cellulose, ethyl cellulose, poly(glutamic acid), casein, gelatin, starch, polyamides, phenolic resins, poly(vinyl formal), polyurethane elastomers, alkyd resins, ethylene-vinyl acetate copolymers, and vinylpyrrolidone-vinyl acetate copolymers.

42. The electrophotographic photosensitive member of claim 41, wherein the first intermediate layer is a polyamide coat.

43. The electrophotographic photosensitive member of claim 42, wherein the polyamide is a nylon or a nylon copolymer.

44. The electrophotographic photosensitive member of claim 41, wherein the first intermediate layer is a poly(vinyl alcohol) coat.

45. The electrophotographic photosensitive member of claim 38, wherein the low resistivity material is a metal powder or a metal oxide powder.

46. The electrophotographic photosensitive member of claim 45, wherein the low resistivity material is the powder of at least one metal selected from the group consisting of aluminum, nickel, copper, silver, gold, zinc, tin, titanium, lead, indium and carbon.

47. The electrophotographic photosensitive member of claim 45, wherein the metal oxide powder is at least one member selected from the group consisting of titanium oxide powder and tin oxide powder.

48. The electrophotographic photosensitive member of claim 45, wherein the low resistivity material is carbon powder 49. The electrophotographic photosensitive member of claim 47, wherein the titanium oxide powder is a surface-treated one.

50. The electrophotographic photosensitive member of claim 49, wherein the surface treatment is to form an alumina coat on the titanium oxide particle.

51. The electrophotographic photosensitive member of claim 49, wherein the surface treatment is to form a tin oxide coat on the titanium oxide particle.

52. The electrophotographic photosensitive member of claim 47, wherein the titanium oxide is of rutile type.

53. The electrophotographic photosensitive member of claim 41, wherein the second resin layer is a coat comprising at least one resin selected from the group consisting of poly(vinyl alcohol), poly(vinyl methyl ether), poly(vinyl ethyl ether), polyvinylpyridine, polyvinylpyrrolidone, poly(ethylene oxide), poly(acrylic acid), methyl cellulose, ethyl cellulose, poly(glutamic acid), casein, gelatin, starch, polyamides, phenolic resins, poly(vinyl formal), polyurethane elastomers, alkyd resins, ethylene-vinyl acetate copolymers, and vinylpyrrolidone-vinyl acetate copolymers.

54. The electrophotographic photosensitive member of claim 38, wherein the resin layer is a polyamide coat.

55. The electrophotographic photosensitive member of claim 54, wherein the polyamide is a nylon or a nylon copolymer.

56. The electrophotographic photosensitive member of claim 53, wherein the second resin layer has a thickness of 0.3–2$\mu$.

57. The electrophotographic photosensitive member of claim 38, wherein the photosensitive layer is a lamination of a charge generation layer and a charge transport layer.

* * * * *

UNITED STATES PATENT AND TRADEMARK OFFICE

CERTIFICATE OF CORRECTION

PATENT NO. : 4,518,669

DATED : May 21, 1985

INVENTOR(S) : Yuichi Yashiki

It is certified that error appears in the above-identified patent and that said Letters Patent is hereby corrected as shown below:

Column 3, line 38, "thereby hydrolize $SuCl_2$" should read --thereto to hydrolize $SnCl_2$--.

Column 7, line 25, "resis" should read --resins--.

Column 8, line 51, "preferabely" should read --preferably--.

Column 10, line 24, "-5.6 IV" should read -- -5.6 KV--.

Column 12, line 68, "it any" should read --it with any--.

Claim 16, line 2, "claim 10" should read --claim 15--.

Claim 38, line 5, "at least 1" should read --at least 1 micron--.

lines 6-7, "low electroconductive substance" should read --low resistivity material--.

UNITED STATES PATENT AND TRADEMARK OFFICE

CERTIFICATE OF CORRECTION

PATENT NO. : 4,518,669

DATED : May 21, 1985

INVENTOR(S) : Yuichi Yashiki

It is certified that error appears in the above-identified patent and that said Letters Patent is hereby corrected as shown below:

Claim 53, line 2, "claim 41" should read --claim 38--.

Claim 54, line 2, "claim 38" should read --claim 53--.

Claim 56, line 2, "claim 53" should read --claim 38--.

Signed and Sealed this

*Eighth* Day of *October 1985*

[SEAL]

*Attest:*

DONALD J. QUIGG

*Attesting Officer*

*Commissioner of Patents and Trademarks—Designate*